US008025488B2

(12) United States Patent
Sellas et al.

(10) Patent No.: US 8,025,488 B2
(45) Date of Patent: Sep. 27, 2011

(54) TRANSFER PUMP FOR HIGH-PRESSURE GASOLINE INJECTION

(75) Inventors: Florent Sellas, Colombes (FR); Dominique Veret, Verrieres le Buisson (FR)

(73) Assignee: Continental Automotive Asnieres France, Asnieres-sur-Seine (FR)

( * ) Notice: Subject to any disclaimer, the term of this patent is extended or adjusted under 35 U.S.C. 154(b) by 560 days.

(21) Appl. No.: 12/294,242

(22) PCT Filed: Mar. 5, 2007

(86) PCT No.: PCT/FR2007/000388

§ 371 (c)(1),
(2), (4) Date: Oct. 10, 2008

(87) PCT Pub. No.: WO2007/110492

PCT Pub. Date: Oct. 4, 2007

(65) Prior Publication Data

US 2009/0169398 A1 Jul. 2, 2009

(30) Foreign Application Priority Data

Mar. 24, 2006 (FR) ..... 06 02594

(51) Int. Cl.
*F04B 43/10* (2006.01)

(52) U.S. Cl. ..... 417/394; 123/446

(58) Field of Classification Search ..... 123/456, 123/445, 446–447, 495, 506; 417/201, 202, 417/415, 540, 221
See application file for complete search history.

(56) References Cited

U.S. PATENT DOCUMENTS

| | | | |
|---|---|---|---|
| 4,080,107 | A | 3/1978 | Ferrentino |
| 6,554,578 | B1 | 4/2003 | Siegel |

FOREIGN PATENT DOCUMENTS

| | | | |
|---|---|---|---|
| DE | 38 01 929 | A1 | 8/1988 |
| EP | 0 081 076 | A1 | 6/1983 |
| FR | 1 128 565 | A | 1/1957 |
| FR | 2 323 036 | A | 4/1977 |
| FR | 2 828 240 | A | 2/2003 |

*Primary Examiner* — Nimeshkumar Patel
*Assistant Examiner* — Donald Raleigh
(74) *Attorney, Agent, or Firm* — Young & Thompson

(57) ABSTRACT

Transfer pump for high-pressure petrol injection of the type including a piston (1) which delivers oil into a deformable element such as a bellows (8), the deformations of the bellows (8) in a cylindrical chamber (6) filled with fuel causing a pumping effect whereby the fuel is pumped towards a rail (40) supplying high-pressure injectors, wherein elements are arranged for diverting some or all of the oil pumped by the piston (1) towards a chamber (15) without pressuring it so as to determine at will the useful stroke of the piston (1) and hence the quantity of fuel pumped at high pressure towards the rail (40).

10 Claims, 3 Drawing Sheets

TRANSFER PUMP FOR HIGH-PRESSURE GASOLINE INJECTION

This invention relates to the supply of gasoline under high pressure of injectors for internal combustion engines.

Recent works have shown that the yield of an internal combustion engine would improve considerably using gasoline as a fuel by injecting this fuel at high pressure by what is called a common rail.

In particular, to implement such a supply, pumps called transfer pumps have been used in which there is an elastically deformable element, resistant to the attacks of modern fuels (containing chemically aggressive additives), whereby the deformations of this element are caused by a high-pressure hydraulic pump.

It has been possible, with this type of pump, to operate engines experimentally, but it was then necessary to solve the problems posed by regulating the flow rate of gasoline or else by the remanence of gasoline at high pressure in the supply circuit after the engine is stopped.

Regarding the regulation of the gasoline flow rate, two methods have been explored: on the one hand, the regulation of the gasoline flow rate by partial recycling of this flow rate downstream from the pump; on the other hand, the regulation of the gasoline supply of the pump, upstream from the latter.

In contrast, it was proposed to implement the regulation portion of the gasoline flow rate by acting on the supply of oil of the transfer pump.

Devices of this type have been described in the U.S. Pat. Nos. 2,826,068 and 2,828,240 that were filed in the name of the applicant.

This invention also has the object of implementing the regulation of the gasoline flow rate by implementing this regulation in the oil portion, but by other means that are much simpler than those described in the patents cited above.

This invention relates to a transfer pump for high-pressure gasoline injection of the type that comprises a piston that conveys the oil into a deformable element such as a bellows, whereby the longitudinal deformations of said bellows in a fuel-filled cylindrical chamber produce a pumping action of said fuel toward a rail that supplies high-pressure injectors, characterized by the fact that means are used to divert the oil pumped by the piston completely or partially to a chamber without pressurizing it so as to determine as desired the useful travel of said piston and therefore the amount of fuel pumped at high pressure toward the rail.

Figure 1:
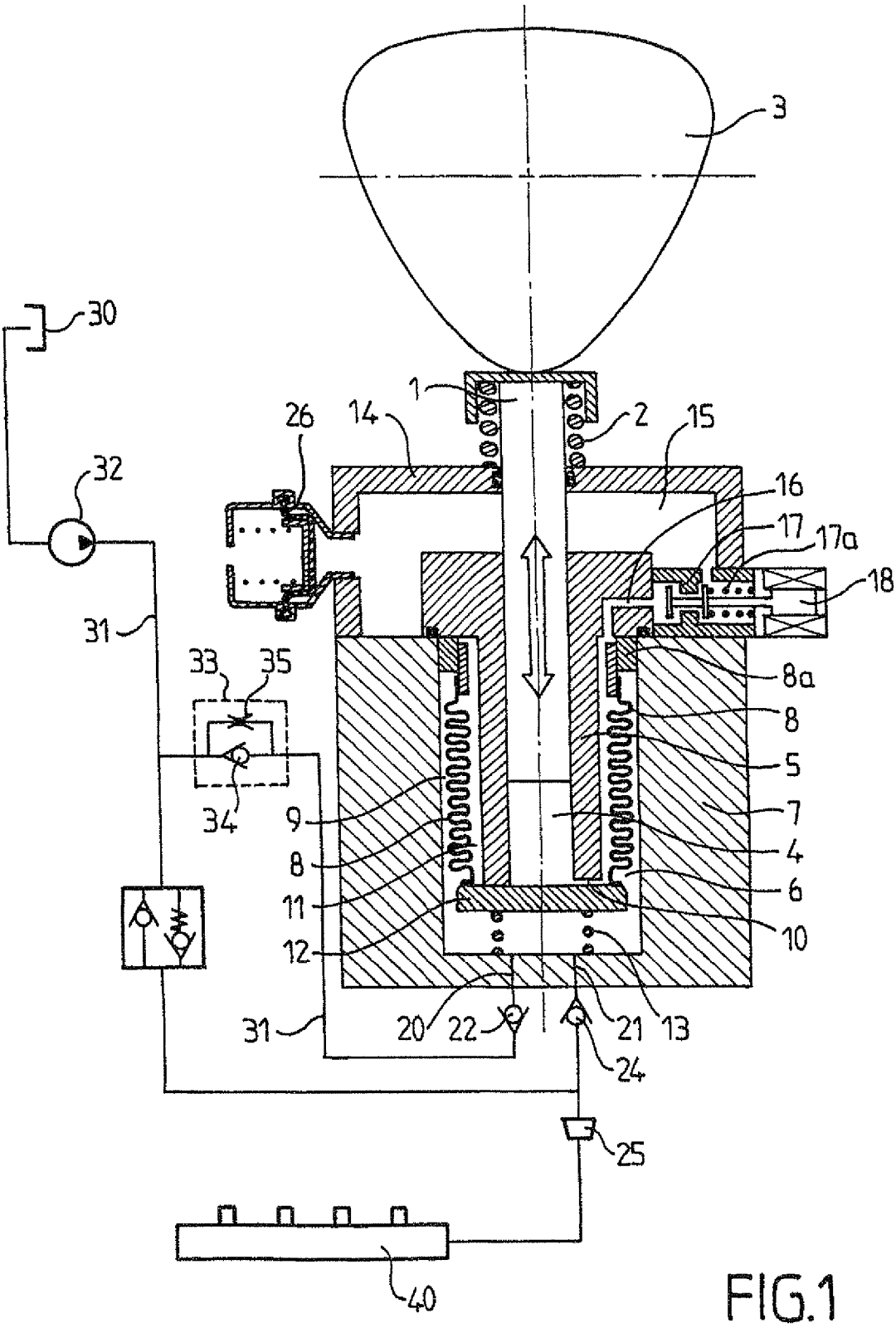

By way of example and to facilitate the understanding of the invention, the following has been shown in the accompanying drawing:

FIG. 1: A diagrammatic cutaway view of a first embodiment of the invention.

Figure 2:
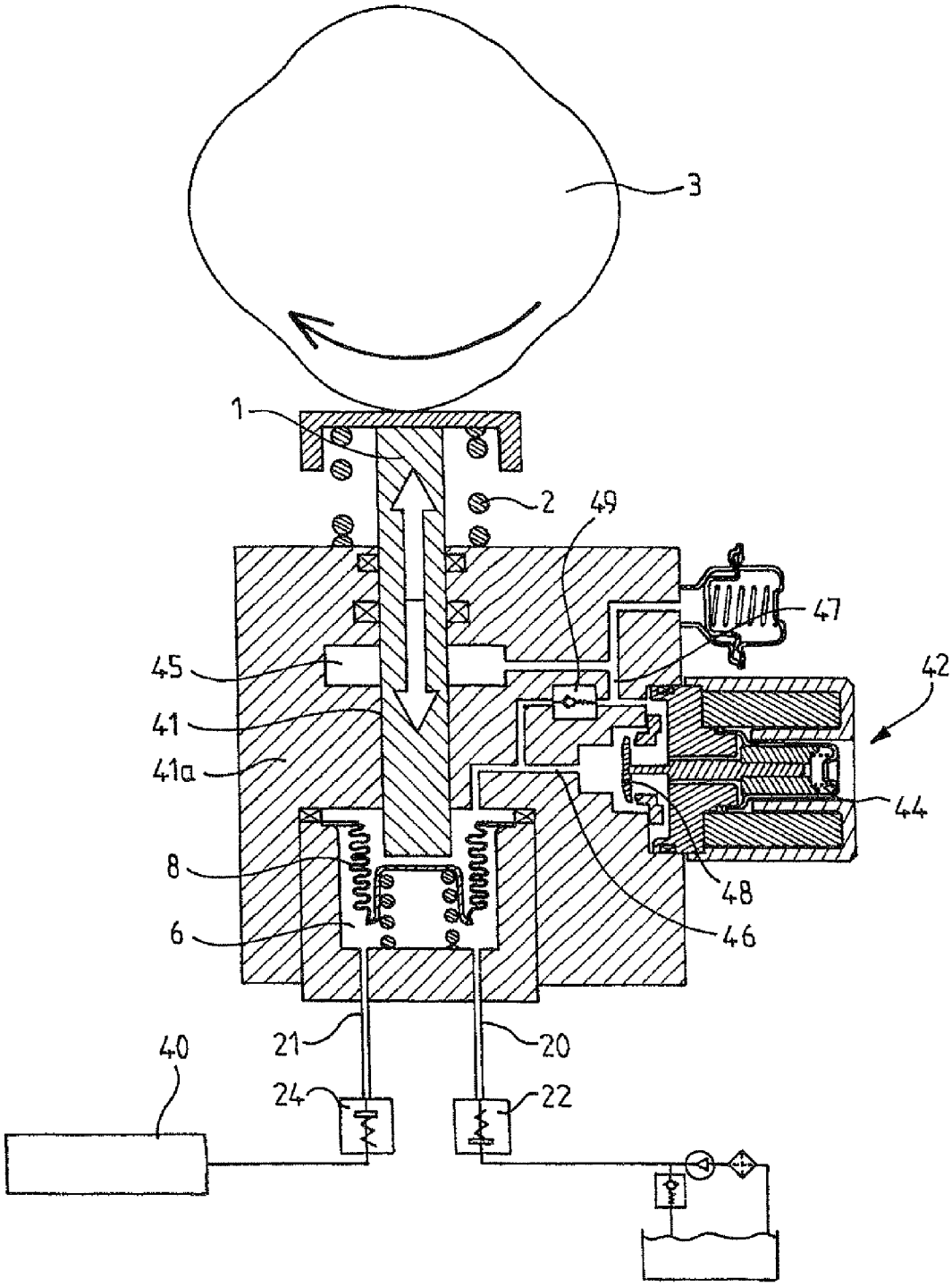

FIG. 2: A diagrammatic cutaway view of a second embodiment of the invention.

Figure 3:
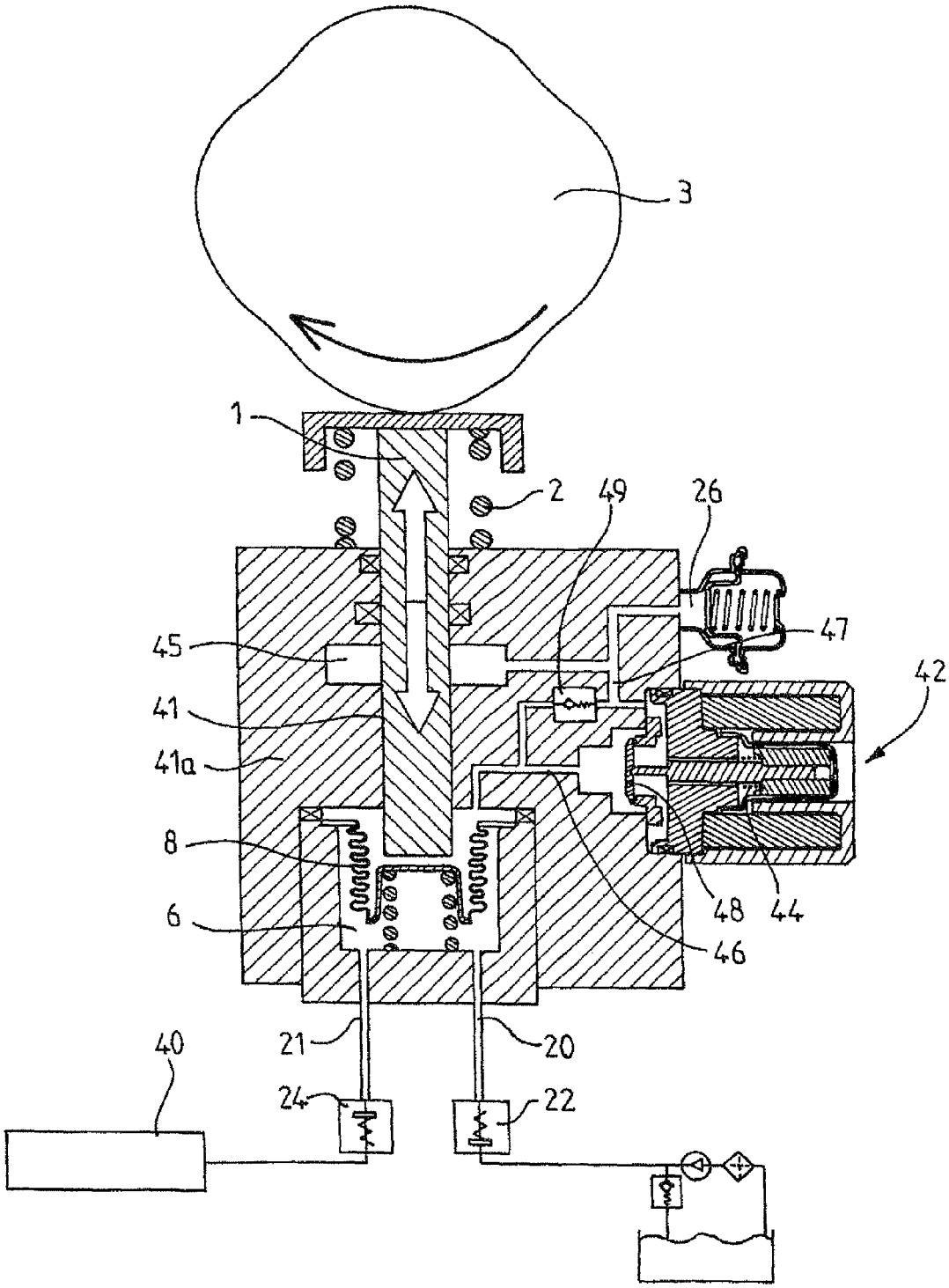

FIG. 3: A diagrammatic view that corresponds to FIG. 2, illustrating an operational variant of the control solenoid valve.

By referring to FIG. 1 , it is seen that the transfer pump according to the invention consists of a piston 1, held by resistance by a spring 2 and actuated by a cam 3 so as to have a back-and-forth movement. In the example shown, the cam 3 comprises three lobes, but this is not limiting.

This piston 1 moves in the bore 4 of a cylinder 5.

This cylinder 5 is placed in a cylindrical chamber 6 that is provided in a pump body 7.

The cylinder 5 is surrounded by a deformable bellows 8, which provides a volume 9 between the outside walls of the bellows 8 and the inside walls of the cylindrical chamber 6.

At the base of the cylinder 5, an opening 10 is used that links the bore 4 of the cylinder 5 with the volume 11 between the inside wall of the bellows 8 and the outside wall of the cylinder 5.

The bellows 8 is attached at its upper end to a flange Sa that is integral with the pump body 7 and at its lower end to a plate 12 that is held by resistance by a spring 13.

A cylinder head 14, attached to the pump body 7, defining with the latter a chamber 15 that communicates via a duct 16 with the volume 11, which communicates via the opening 10 with the base of the bore 4, is arranged above the cylinder 5.

A solenoid valve 17, controlled by a solenoid 18, is inserted between the chamber 15 and the duct 16 that connects the chamber 15 and the volume 11.

This solenoid valve 17 is subjected to the action of a spring **17*a* that tends to keep it open as well as to the action of the solenoid 18. The action of the spring 17*a* and the solenoid 18*a* has the effect of keeping open the solenoid valve 17** in the open position.

The base of the chamber 6 comprises a feed duct 20 and a conveyor duct 21.

The feed duct 20 is connected to a fuel tank 30 via a duct 31 that comprises a supercharging pump 32 and a non-return valve 22.

The conveyor duct 21 comprises a non-return valve 24 in exiting from the pump.

The operation of the thus described device is described below:

The rotation of the cam 3 causes, with the return spring 2, a back-and-forth movement of the piston.

As in the known devices, the oil conveyed by the piston 1 pushes back the plate 12 against its spring 13 by extending the bellows 8. When the plate 12 is lowered, the gasoline that is contained at 6 is conveyed through the non-return valve 24; when the plate 12 returns to its starting position, the gasoline is allowed into the chamber 6 by passing through the non-return valve 22.

According to this invention, the solenoid valve 17 is normally open, such that the oil that is conveyed at 4 by the piston 1 passes through the opening 10, passes through the volume 11, and, via the duct 16, returns into the chamber 15 without rising in pressure; the plate 12 remains immobile, and the rail 40 does not receive fuel. When the solenoid valve 17 is closed, the oil that is conveyed by the piston I can no longer flow through the duct 16, the plate 12 is pushed back, and fuel under high pressure is sent into the rail 40.

The solenoid 18 has as its function to keep the solenoid valve 17 open when it is activated. When it is not activated, the pressure difference of the oil between the duct 16 and the chamber 15 causes it to close.

The amount of fuel sent into the rail 40 is therefore determined by the amount of oil that is moved by the piston 1 when the solenoid valve 17 is closed.

The total travel of the piston 1 determines the maximum possible amount of fuel sent to the rail 40 when all of the oil that is found in the bore 4 is moved, the solenoid valve 17 being closed. By more or less reducing the amount of oil moved, the amount of fuel sent to the rail 40 is reduced proportionately.

This reduction is achieved by keeping the solenoid valve 17 open for the time necessary to eliminate the surplus oil.

Once the amount of surplus oil is eliminated, the solenoid valve 17 is deactivated, which brings about its closing and therefore the pumping action toward the rail 40.

Thus, according to this invention, the entire volume of surplus oil is directly conveyed into the chamber 15, without being pressurized and remixed with the oil that is found in this chamber, which prevents any heating of the oil.

The thus described pump is analogous to a pump with a variable capacity.

When the outlet flow rate at 21 is zero, the travel of the bellows 8 is zero, which improves its long-term strength.

A device of the known type 26, analogous to an accumulator, offsets the variations of the volume of oil entering or exiting from the chamber 15.

Preferably, as is shown, a non-return valve 25, completely airtight, is used on the duct supplying the rail 40.

This completely airtight valve is made by casting a material such as rubber on a metal part. The complete air tightness is ensured by the rubber, and the metal part prevents the extrusion of the rubber under the action of the pressure.

The position of the valve 25 is to be determined such that the gasoline volume between said non-return valve 25 and the chamber 6, in which the bellows is found, is small enough to prevent a deformation of the bellows 8 in the event the engine stops in a high pressure state.

As is shown, the gasoline feed duct 31 can comprise a device 33 that is designed to prevent the pulses caused by the pump.

This device consists of the combination of a non-return valve 34 and a passage that is calibrated in a bypass of said valve 34.

FIG. 2 shows a variant of FIG. 1, whereby the identical elements bear the same references.

As in the case of FIG. 1, the transfer pump consists of a piston 1, held by resistance by a spring 2 and actuated by a cam 3 (which comprises four lobes in this example).

This piston 1 moves in a bore 41 that is provided in a pump body 41*a*.

This piston 1 moves inside a deformable bellows 8, which is placed in a cylindrical chamber 6 and which communicates with the bore 41.

The bore 41 comprises a circular chamber 45, which will fill the role of the chamber 15 of FIG. 1.

The internal volume of the bellows 8 is connected by a duct 46 to a solenoid valve 42.

This duct 46 comprises a bypass 46*a* that, through an overpressure valve 49, communicates with a duct 47.

This duct 47 connects the solenoid valve 42 to the accumulator 26, which plays the role of thermal compensator and volume compensator.

In FIG. 2, it is seen that the spring 44 of the solenoid valve 42 exerts a thrust that keeps the valve 48 in open position for which the duct 46 communicates with the duct 47 and therefore with the chamber 45 and the accumulator 26.

In FIG. 3, it is seen that the spring 44 of the solenoid valve 42 exerts a force that acts on the valve 48 in closed position.

When the valve 48 of the solenoid valve 42 is closed, the volume of hydraulic liquid that is found inside the bellows 8 is pressurized by the movement of the piston 1; this bellows extends so that the fuel that is found in the chamber 6 is conveyed via the duct 21 toward the rail 40.

When the valve 48 of the solenoid valve 42 is open, the hydraulic liquid that is found inside the bellows 8 flows through this valve into the duct 47 and toward the accumulator 26 and the chamber 45 such that there is no pumping action.

The difference between the arrangement of FIG. 2 and that of FIG. 3 is that the operation is not the same in the event of a failure or non-supply of the solenoid valve 42.

If such a problem occurs:

In the case of FIG. 3, the valve 48 remains closed and, at the beginning, a maximum flow is sent to the rail 40. This has the effect that the overpressure valve 49 opens: the entire flow then goes into the accumulator 26 and, whereby the pump is no longer supplied with hydraulic liquid, is drained, such that the engine operates at low-pressure injection.

In the case of FIG. 2, the valve 48 is stressed in open position by the spring 44, but the hydraulic liquid, arriving via the duct 46, acts on said valve and closes it again, which has the effect that the pumping function continues, the rail 40 remains supplied, and the engine continues to operate at high-pressure injection.

One or the other of these methods of operation will be selected by the user.

The invention claimed is:

1. Transfer pump for high-pressure gasoline injection, characterized by the fact that it comprises a piston (1) that moves in an alternative manner into a bore (4) that is provided in a cylinder (5) that is itself placed in a fuel-filled cylindrical chamber (6), whereby said cylinder (5) is surrounded by a bellows (8) whose internal chamber (11) communicates, on the one hand, with the bore (4) via an opening (10), and, on the other hand, with an oil reserve (15) by means of a duct (16) that is equipped with a solenoid valve (17); whereby the back-and-forth movements of the piston (1) cause the extending and the shortening of said bellows (8), itself integral with a plate (12) that, by its movements, draws in and conveys the fuel; whereby the oil that is pumped by the piston (1) can be diverted completely or partially by means of the solenoid valve (17) to the oil reserve (15) without being pressurized, which determines as desired the useful travel of said piston (1) and therefore the amount of fuel pumped at high pressure toward a rail (40).

2. Pump according to claim 1, wherein when the solenoid valve is open, the oil that is moved by the piston (1) is returned into the chamber (15) without being pressurized, whereby the bellows (8) and the plate (12) are activated only when the solenoid valve (17) is closed.

3. Pump according to claim 2, in which the solenoid valve (17) is open when it is activated and closed by the pressure difference between its terminals.

4. Pump according to claim 3, wherein during the travel for supply of the piston, the oil is introduced into the bore (4) via the duct (16) through the solenoid valve (17).

5. Pump according to claim 1, wherein the piston (1) is moved via a cam (3) that can comprise one or more lobes.

6. Pump according to claim 1, wherein the piston (1) moves into a bore (41) that is provided in a pump body (41*a*), communicating with the inside volume of a bellows (8) that is placed in a cylindrical chamber (6); whereby this internal volume of the bellows (8) communicates through the valve (48) of a solenoid valve (42) with a chamber (45) and an accumulator (26) such that when said valve (48) is closed, there is a pumping action of the fuel, and when said valve (48) is open, there is no pumping action.

7. Pump according to claim 6, wherein the valve (48) of the solenoid valve (42) is stressed by the spring (44) of said solenoid valve in closed position such that in the event that the control of the solenoid valve fails, there is a maximum flow rate of oil, which has the effect of causing the opening of the overpressure valve (49), which drains the pump, and the engine operates under low-pressure injection.

8. Pump according to claim 6, wherein the valve (48) of the solenoid valve (42) is stressed by the spring (44) in open position such that in the event that the control of the solenoid valve fails, the hydraulic liquid that arrives via the duct (46) acts on said valve (48), which maintains the high-pressure pumping function.

9. Pump according to claim 1, wherein the duct that goes from the pump to the injection rail (40) is provided with an airtight valve (25) that is placed in a position such that the pipe volume going from said valve (25) to the chamber (6) where the bellows (8) is found has as small a volume as possible to prevent hydroforming in the event the engine stops in a high-pressure state.

10. Pump according to claim 1, wherein the feed duct (31) of the pump comprises an anti-pulsing device (33).

* * * * *